US006283330B1

(12) United States Patent
Gillespie et al.

(10) Patent No.: US 6,283,330 B1
(45) Date of Patent: Sep. 4, 2001

(54) CLEANING SOLUTION DILUTION AND DISPENSING SYSTEM

(75) Inventors: Daniel C. Gillespie, Southborough; Glenn Szabo, Northborough; John H. Grimes, Jr., Holliston; William R. Rebh, Jr., Shrewsbury, all of MA (US)

(73) Assignee: The Butcher Company, Marlborough, MA (US)

( * ) Notice: Subject to any disclaimer, the term of this patent is extended or adjusted under 35 U.S.C. 154(b) by 0 days.

(21) Appl. No.: 09/382,762

(22) Filed: Aug. 25, 1999

(51) Int. Cl.[7] ..... B67D 5/60

(52) U.S. Cl. ..... 222/145.7; 222/181.1; 222/185.1; 222/325

(58) Field of Search ..... 222/185.1, 481.5, 222/181.1, 145.1, 145.7, 325

(56) References Cited

U.S. PATENT DOCUMENTS 4,141,467 * 2/1979 Augustijn et al. ..... 222/145.7
5,209,377 * 5/1993 Steiner et al. ..... 222/325
5,273,186 * 12/1993 Widmer ..... 222/325
5,425,404 * 6/1995 Dyer ..... 222/325

* cited by examiner

*Primary Examiner*—Philippe Derakshani
(74) *Attorney, Agent, or Firm*—S. C. Johnson Commercial Markets, Inc.

(57) ABSTRACT

A dilution control system for diluting a first fluid with a second fluid and dispensing diluted fluid is disclosed. The dilution control system includes a bottle that is adapted for receiving a quantity of the first fluid. A valve insert is disposed in the opening of the bottle and includes at least one valve for controlling the flow of the first fluid from the bottle and an air vent. The dilution control system further includes a dispenser assembly having a body with at least one mixing chamber for receiving quantities of the first and second fluids and dispensing the diluted fluid, a platform for engaging and supporting the bottle on the body while dispensing the first fluid into the chamber, and a manifold assembly for dispensing the second fluid into the chamber and for actuating the valve and the air vent of the valve insert. The manifold assembly actuates the valve and the air vent for allowing the first fluid to flow into the mixing chamber only while dispensing the second fluid into the chamber. The dilution control system is especially useful for diluting and dispensing concentrated chemical cleaning fluids.

30 Claims, 11 Drawing Sheets

CLEANING SOLUTION DILUTION AND DISPENSING SYSTEM

BACKGROUND OF THE INVENTION

1. Field of the Invention

This invention relates generally to dilution control systems, and more particularly to systems for diluting and dispensing concentrated chemical cleaning fluids. The dilution control system of the present invention includes a container of chemical cleaning fluid releasably mounted to a plastic dispensing structure, which is in fluid communication with a water source. The dispensing structure includes an externally actuated switch for activating a mechanism in the dispensing structure that permits release of the chemical cleaning fluid from the container. When the switch is actuated, a diluted aqueous solution of the chemical cleaning fluid flows out of the dispensing structure at about the same time that water flows into the dispensing structure. The diluted aqueous solution can then be received in a bottle or a bucket for use, e.g. in cleaning targeted surfaces such as floors and bathroom fixtures.

2. Background

Dilution control systems are commonly used in the sanitary maintenance industry for diluting and dispensing concentrated chemical cleaning fluids. Such systems allow sanitary maintenance personnel to take advantage of the economies that can be derived from purchasing chemical cleaning fluids in concentrated form, and then diluting and dispensing the cleaning fluids at the locations where they are needed. It is therefore important that dilution control systems dilute and dispense the cleaning fluids accurately, thereby achieving a desired chemical concentration for cleaning purposes and avoiding wasteful overuse of the concentrated chemical cleaning fluid.

Further, because concentrated chemical cleaning fluids are often harmful to sanitary maintenance workers when they come into direct contact with the fluid products, it is also important that dilution control systems dilute and dispense the cleaning fluids safely, thereby eliminating any unwanted dispersion or spillage of the concentrated and/or diluted cleaning fluids. Finally, because sanitary maintenance workers as a group typically have a range of skill levels, from highly skilled sanitary maintenance engineers to unskilled custodial workers, it is important that dilution control systems are convenient and easy-to-use, thereby avoiding any complicated measurements and/or operating procedures.

Various systems have been used for dilution control in the sanitary maintenance industry. Several such dilution control systems are sold by The BUTCHER™ Company ("BUTCHER"), Marlborough, Mass., USA. For example, BUTCHER sells the PIPELINE® concentrate bottle, which has a built-in measuring chamber for accurately dispensing measured quantities of concentrated chemical cleaning fluids for subsequent dilution. Further, BUTCHER sells the KDS™ keg delivery system, which includes measured quantities of concentrated chemical cleaning fluid for subsequent dilution in a multi-gallon keg.

Although the PIPELINE® concentrate bottle and the KDST™ delivery system have both been successfully used for accurately, safely, and conveniently diluting and dispensing concentrated chemical cleaning fluids, these dilution control systems have a drawback in that they are primarily useful for low volume cleaning applications.

BUTCHER also sells the COMMAND CENTER® dilution control system, which utilizes a venturi effect for drawing concentrated chemical cleaning fluids into a flow of water. Specifically, the COMMAND CENTER® dilution control system includes an eductor, which has a thin tube with a hole in its side. Water flowing through the tube creates a vacuum at the hole, which draws the concentrated chemical cleaning fluid into the tube. The eductor also includes tips with various sized holes for controlling the amount of concentrated chemical cleaning fluid that is drawn into and diluted by the water flow. Accordingly, a desired concentration of chemical cleaning fluid can be quickly and easily dispensed into a bottle or a bucket for subsequent use.

Although the COMMAND CENTERS® dilution control system has also been successfully used for safely and conveniently diluting and dispensing concentrated chemical cleaning fluids in high volume cleaning applications, using the venturi effect to draw a concentrated chemical cleaning fluid into a water flow for dilution purposes sometimes does not provide the desired level of accuracy.

In U.S. Pat. No. 5,425,404 ("the '404 patent") issued Jun. 20, 1995, to Dyer, a gravity-feed fluid dispensing system for dispensing a fluid and for mixing the fluid with another fluid is described. In accordance with that disclosure, the fluid dispensing system includes a bottle containing a quantity of fluid, which is inverted and engaged with the dispenser assembly. The fluid dispensing system is constructed so that the bottle is opened to allow the fluid to flow through the system when the bottle is engaged with the system, and to close the bottle when the bottle is not engaged with the system. A second fluid, e.g., water, may be introduced into the system and mixed with the first fluid, e.g., a concentrated chemical cleaning fluid, in a controlled manner to dilute the first fluid.

However, the dispensing system described in the '404 patent also has some drawbacks. For example, that dispensing system uses rotational manipulation of the bottle containing the concentrated chemical cleaning fluid to activate fluid flow from the bottle. Custodial workers must therefore completely rotate the bottle to an "on" or "open-flow" position for diluting and dispensing the concentrated chemical cleaning fluid, and then completely rotate the bottle to an "off" or "top-flow" position for preventing any further unwanted flow of the cleaning fluid from the bottle. However, custodial workers, especially those with low skill levels, may fail to rotate the bottle back to the stop-flow position after dispensing the cleaning fluid, thereby causing the cleaning fluid to leak from the inverted bottle. The dispensing system described in the '404 patent therefore lacks the high level of convenience required by today's sanitary maintenance workers.

It would therefore be desirable to have a dilution control system that can be used for accurately, safely, and conveniently diluting and dispensing concentrated chemical cleaning fluids. Such a system would be suitable for use in high volume cleaning applications. It would also be desirable to have a dilution control system that prevents overuse and/or leakage of concentrated chemical cleaning fluids from the system.

SUMMARY OF THE INVENTION

The foregoing and other drawbacks of the prior art have been overcome by a dilution control system according to the present invention. In a preferred embodiment, the dilution control system includes a bottle adapted for receiving a quantity of a first fluid. The bottle has at least one first valve disposed in an opening thereof for controlling the flow of the first fluid from the bottle, where the first valve is biased to a closed position. The dilution control system also includes a dilution and dispenser assembly for supporting the bottle while diluting and dispensing the first fluid. The dilution/dispenser assembly includes a body having at least one fluid collector with a receiving opening and a dispensing opening; a top platform for engaging and supporting the bottle on the body with the opening of the bottle being directed downward in registration with the receiving opening of the fluid collector; and, a manifold assembly including at least one inlet for receiving a second fluid, at least one outlet in fluid communication with the inlet, the outlet being directed downward in registration with the receiving opening of the fluid collector, at least one actuator in fluid communication with the inlet for moving the first valve disposed in the opening of the bottle to an open position, the actuator being triggered by the second fluid flowing through the manifold assembly, and at least one second valve for controlling the flow of the second fluid from the inlet to both the outlet and the actuator, the second valve being biased to a closed position and shiftable to an open position.

A water valve control mechanism is provided for allowing a human operator to shift the second valve in the manifold assembly to the open and the closed positions. Further, a latch is provided for mating and engaging the bottle with the top platform of the dilution/dispenser assembly. Still further, the first valve disposed in the opening of the bottle is incorporated in a valve insert, which preferably further includes an air vent.

When the second valve is shifted to the open position, the second fluid can flow from the inlet to the outlet of the manifold assembly and into the fluid collector. Further, the second fluid can trigger the actuator, thereby causing the first fluid in the bottle to flow into the fluid collector and be mixed with the second fluid for subsequent dispensing of diluted fluid through the dispensing opening of the fluid collector. Advantageously, the dilution control system permits the first fluid to flow from the bottle only when the second fluid is flowing through the manifold assembly, thereby virtually eliminating inadvertent overuse and leakage of the first fluid. For example, the first fluid may be concentrated chemical cleaning fluid and the second fluid may be water.

Still further objects and advantages will become apparent from a consideration of the ensuing description and drawings.

BRIEF DESCRIPTION OF THE DRAWINGS

The invention will be better understood by reference to the following more detailed description and accompanying drawings in which.

DETAILED DESCRIPTION OF THE INVENTION

Figure 1A:
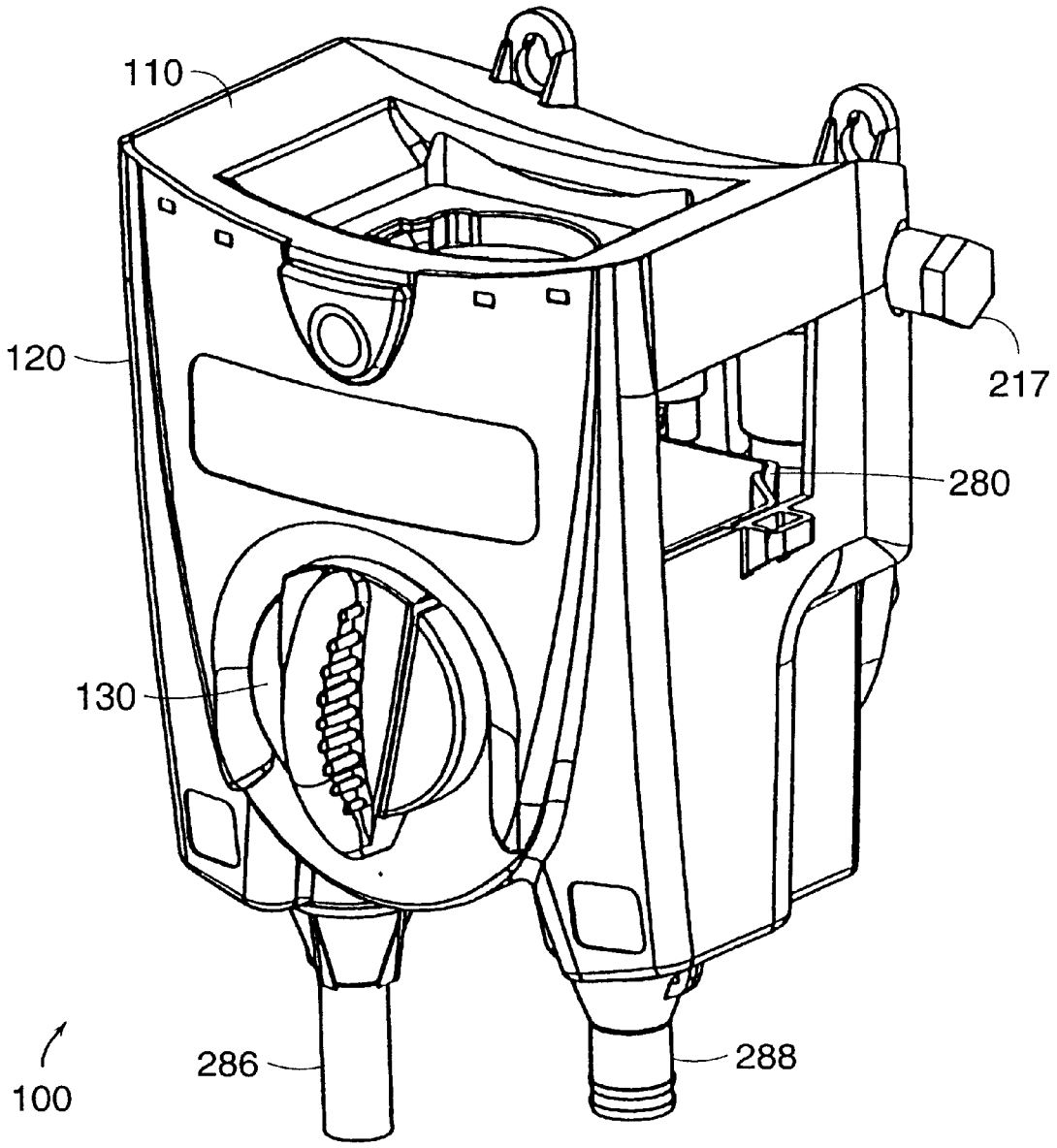
FIG. 1A is an isometric view of a dilution control system in accordance with the present invention.
Figure 1B:
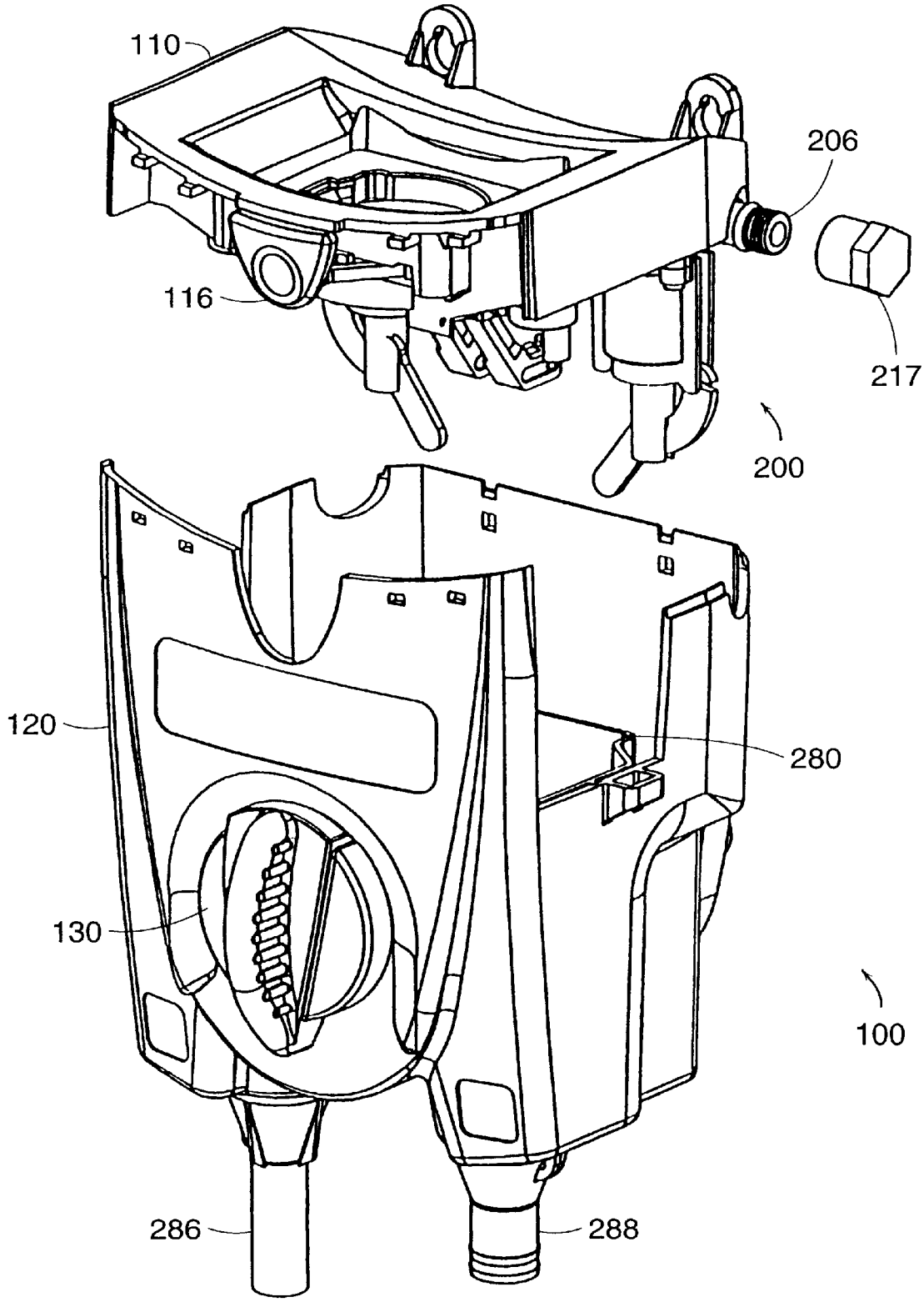
FIG. 1B is an exploded view of the dilution control system of FIG. 1A showing a top platform portion and a lower housing.
Figure 1C:
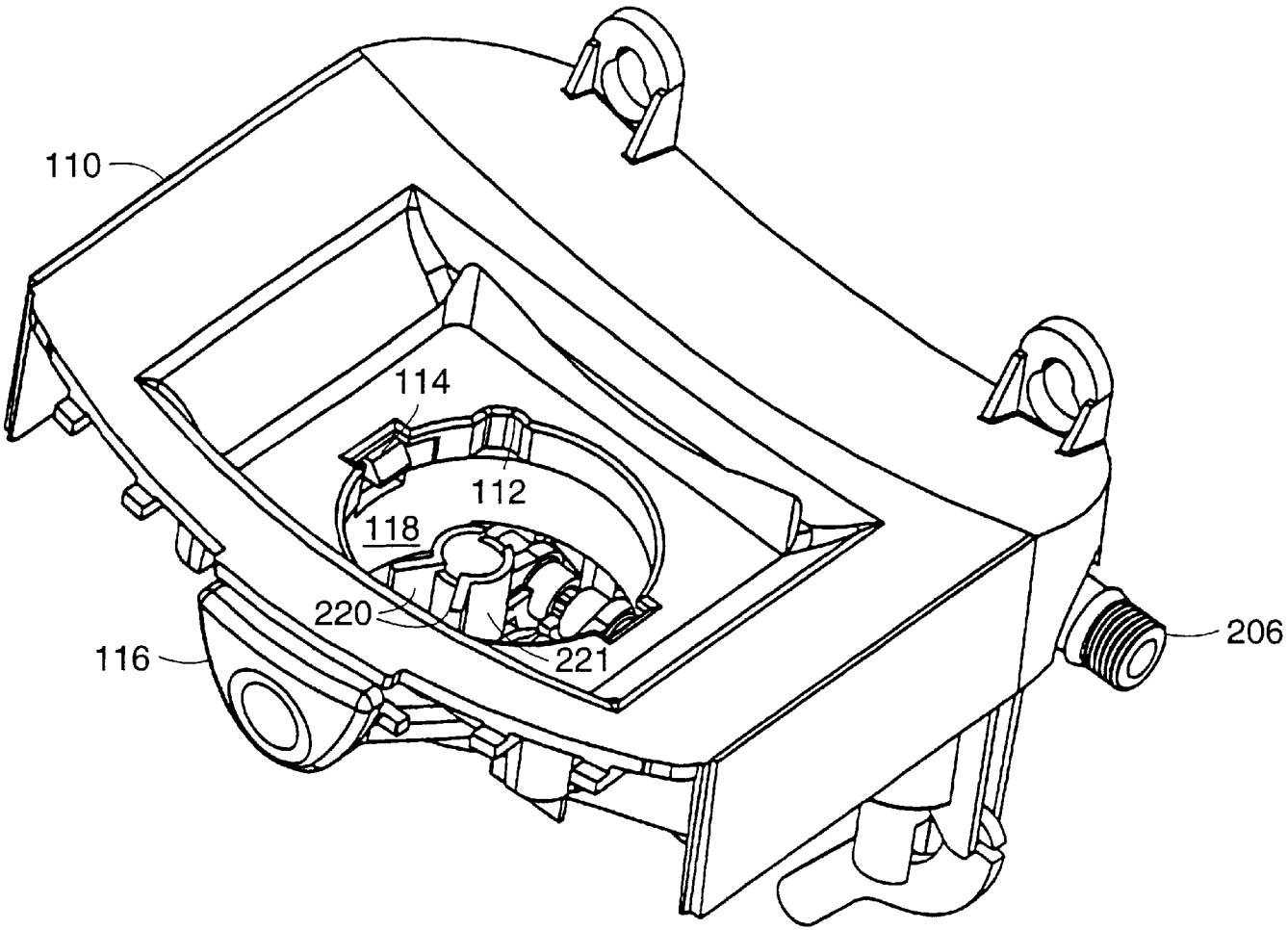
FIG. 1C is an isometric view of the top platform portion of a dilution control system in accordance with the present invention.
Figure 1D:
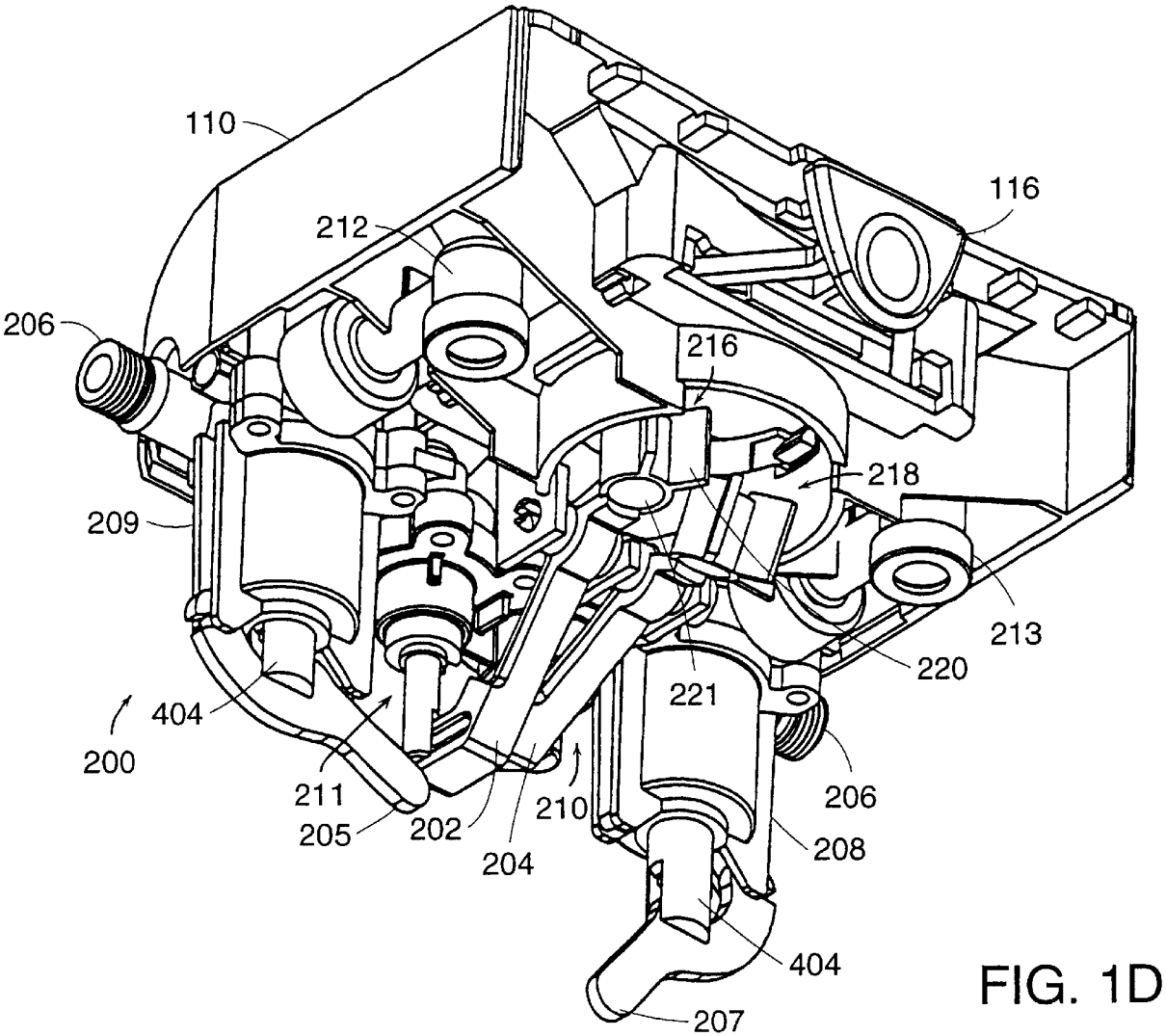
FIG. 1D is an isometric view of the top platform showing a water manifold assembly disposed therein according to the present invention.
Figure 2:
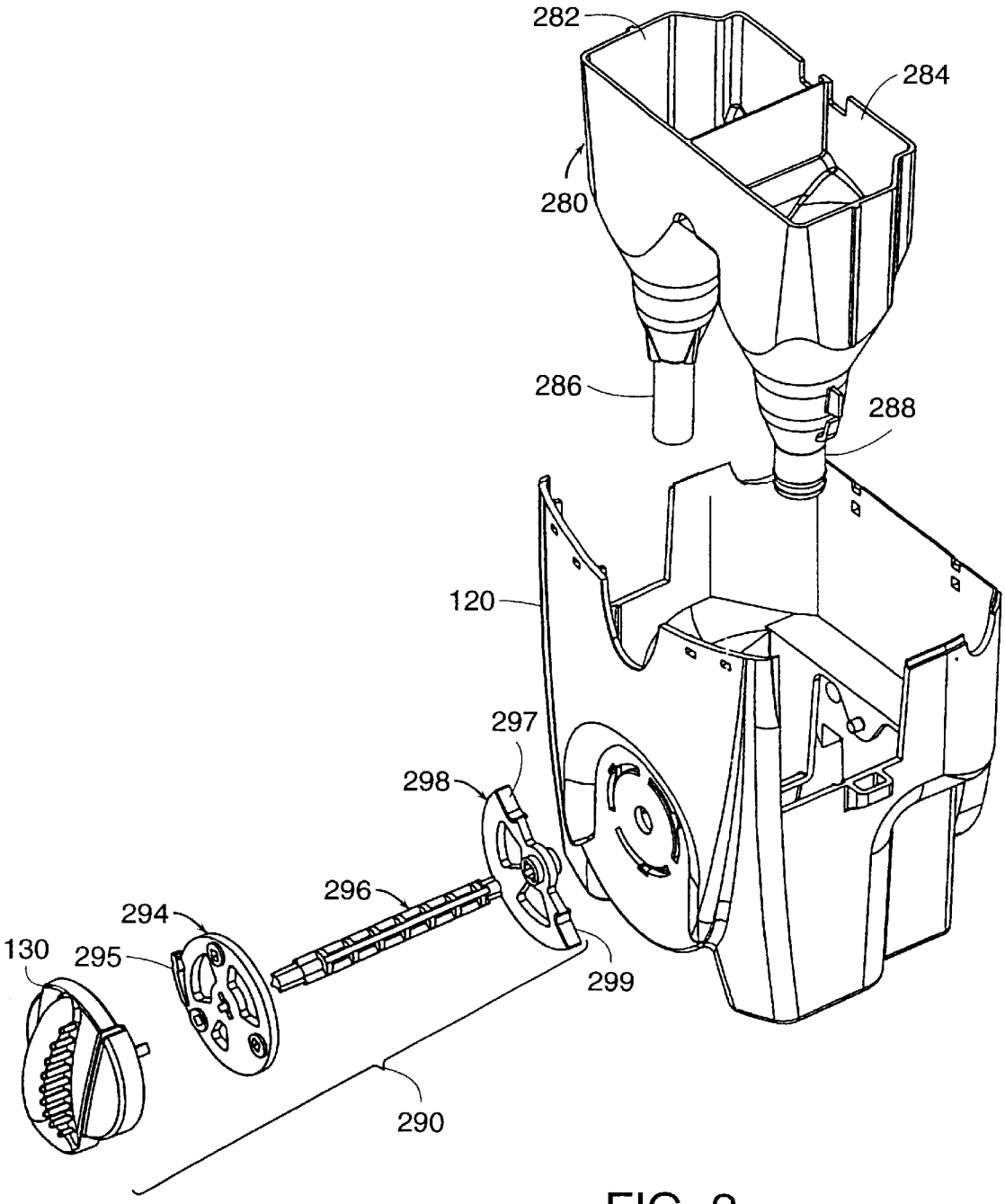
FIG. 2 is an exploded view of the lower housing of the dilution control system showing a fluid collector and an exploded view of a water valve control mechanism in accordance with the present invention.

FIG. 1A shows a dilution control system 100 in accordance with the present invention. The dilution control system 100 includes a top platform 110 as shown in FIGS. 1B, 1C and 1D. The top platform 110 encloses a water manifold assembly 200 (see FIGS. 1B, 1D, 4, 5, 6A, and 6B), which is coupled to the top platform 110 and is in fluid communication with a water source (not shown). The dilution control system 100 also includes a lower housing 120 as shown in FIG. 2. The lower housing 120 encloses a fluid collector 280 and a water valve control mechanism 290.

The dilution control system 100 is advantageously used with a bottle 150 (see FIGS. 9A through 9C) having a valve insert 170 (see FIGS. 7A, 7B, and 8) disposed therein. The bottle 150 contains, e.g., concentrated chemical cleaning fluid (not shown) or other fluid that is to be diluted using the dilution control system 100 for subsequent use by a system operator (not shown), who may be an unskilled custodial worker. Accordingly, when the bottle 150 is fully engaged with the dilution control system 100 as described below, the water valve control mechanism 290, the water manifold assembly 200, and the fluid collector 280 work in concert to dilute the concentrated chemical cleaning fluid contained in the bottle 150 with water from the water source. The system operator may then use the diluted chemical cleaning fluid for cleaning targeted surfaces such as floors, lavatory facilities, or the like.

Figure 3:
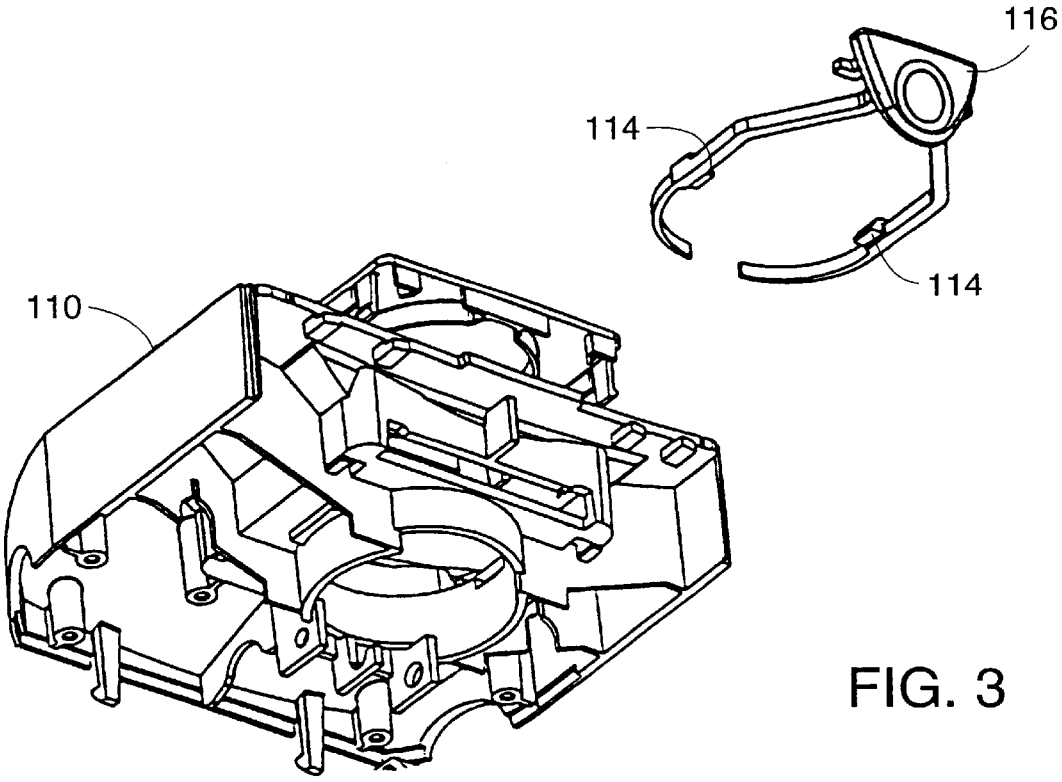
FIG. 3 is an exploded view of a portion of the top platform showing a latch for mating and engaging with a bottle of concentrated fluid according to the present invention.
Figure 9A:
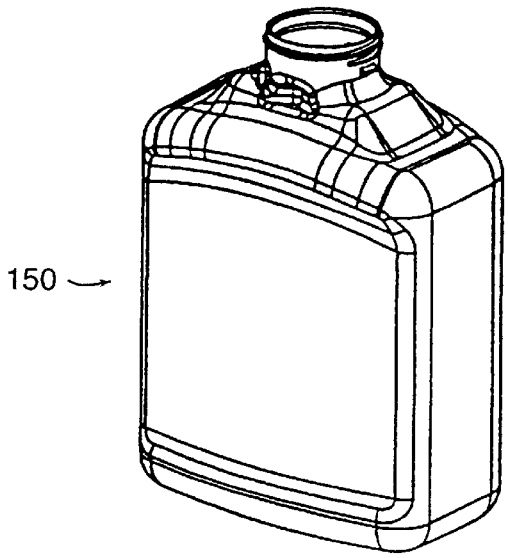
FIG. 9A is an isometric view of the bottle of concentrated fluid in accordance with the present invention.
Figure 9B:
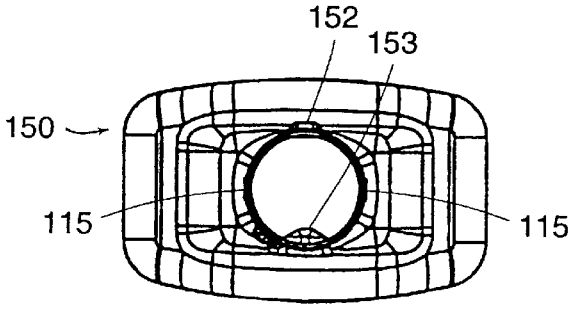
FIG. 9B is a top plan view of the bottle shown in FIG. 9A.
Figure 9C:
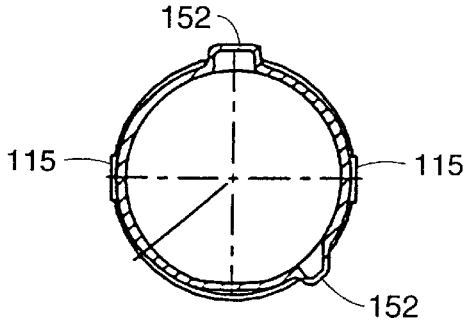
FIG. 9C is a detail view of the bottle shown in FIG. 9B.

The bottle 150 has at least one key 152 radially projecting outwardly from the neck (not numbered) of the bottle 150 (see FIG. 9B and 9C). The key 152 is received in a corresponding keyway 112 extending outwardly from a receiving opening 118 (see FIG. 1C) in the top platform 110 as the bottle 150 is inverted and then engaged with the dilution control system 100. Further, the bottle 150 becomes fully engaged with the dilution control system 100 when at least one latch 114 (see FIGS. 1C and 3) operatively coupled to the top platform assembly 110 mates and engages with a ridge 115 (see FIGS. 9B and 9C) formed in the neck of the bottle 150. A button 116 (see FIGS. 1C, 1D, and 3) operatively coupled to the top platform assembly 110 and the latch 114 can be used for quickly disengaging the bottle 150 from the latch 114, thereby enabling the system operator to remove the bottle 150 from the top platform 110 of the dilution control system 100.

The keying features 152 on the bottle 150 advantageously allow the user to properly orient the bottle 150 with the valve insert 170 relative to the dilution control system 100. Specifically, the keying features 152 cause the valve insert 170 disposed in the opening (not numbered) of the bottle 150 to be properly oriented with bottle valve levers 202 and 204 (see FIG. 1D) coupled to the water manifold assembly 200, thereby ensuring that the bottle valve levers 202 and 204 properly mate with the valve insert 170 during operation of the dilution control system 100.

More specifically, the bottle valve lever 202 simultaneously mates with one flow port 572 and an air vent 576 (see FIG. 7B) included in the valve insert 170. Alternatively, the other bottle valve lever 204 simultaneously mates with another flow port 574 (see FIG. 7B) and the air vent 576 included in the valve insert 170. Further, in an illustrative embodiment, the flow port 574 provides a low flow rate of concentrated chemical cleaning fluid from the bottle 150; and, the flow port 572 provides a high flow rate of the concentrated fluid from the bottle 150.

Accordingly, the bottle valve levers 202 and 204 can be advantageously used for selecting either a low flow rate or a high flow rate of fluid from the same bottle 150. For example, the system operator may select the low flow rate for filling a small container, e.g., a spray bottle, with the diluted cleaning fluid. Alternatively, the user may select the high flow rate for filling a large container, e.g., a bucket, with the diluted cleaning fluid.

The water valve control mechanism 290 in the lower housing 120 includes a rotatable control knob 130 (see FIG. 2) for enabling operation of the bottle valve levers 202 and 204. When the control knob 130 is rotated in, e.g., a clockwise direction to a first position (see FIG. 2), one of the bottle valve levers 202 is enabled; and, when the control knob 130 is rotated in, e.g., a counter-clockwise direction to a second position (not shown), the other bottle valve lever 204 is enabled. Accordingly, the control knob 130 can be used by the system operator for conveniently selecting a desired flow rate of diluted cleaning fluid to be dispensed from the dilution control system 100. Further, when the control knob 130 is rotated to an intermediate "OFF" position, both bottle valve levers 202 and 204 are disabled.

The bottle 150 may be constructed in any conventional manner (e.g., injection molding) using any suitable material such as a polymeric material. The top platform 110 and the lower housing 120 of the dilution control system 100 may also be constructed in any conventional manner (e.g., injection molding) using any suitable material such as a high-impact plastic. It should be noted that the materials selected for fabricating the bottle 150, the top platform 110, and the lower housing 120 must be compatible with the concentrated chemical fluid to be dispensed from the bottle 150.

Figure 4:
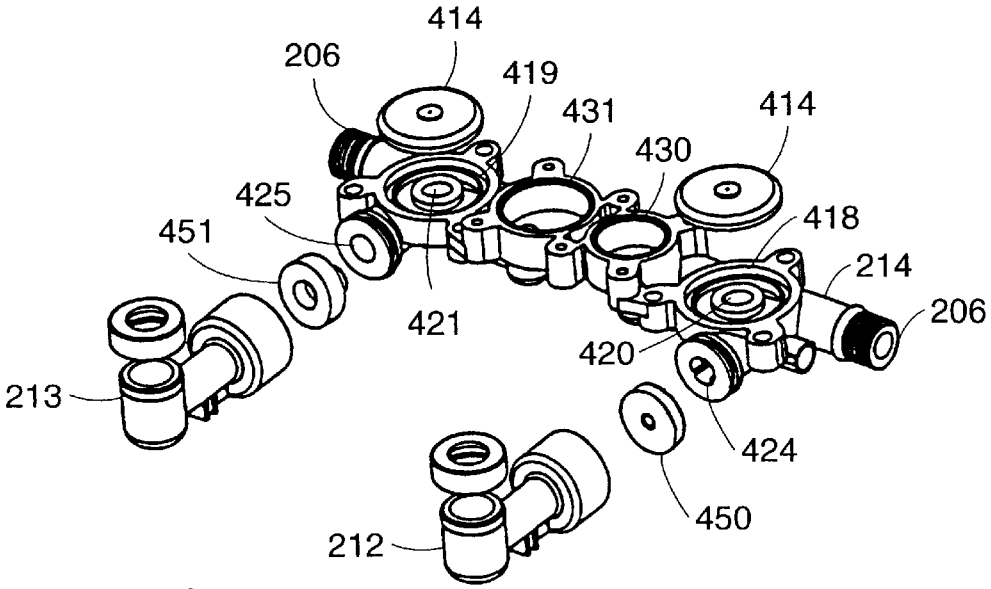
FIG. 4 is an exploded view of a portion of the water manifold assembly in accordance with the present invention.

FIG. 4 shows an exploded view of a portion of the water manifold assembly 200 enclosed by the top platform 110. Specifically, the water manifold assembly 200 includes a pair of opposing fluid inlets 206 (see also FIGS. 1C, 1D, 5, 6A, and 6B), fluid valve assemblies 208 and 209 (see FIGS. 1C, 1D, and 5), fluid diaphragm assemblies 210 and 211 (see FIGS. 1D, and 5), the bottle valve levers 202 and 204, and outlets 212 and 213 (see FIG. 4) for outputting fluid, preferably water from the water source, to be used for diluting the concentrated chemical fluid from the bottle 150.

The opposing fluid inlets 206 are coupled by a generally tubular channel 214, which enables the dilution control system 100 to be used as either a stand-alone unit or as one of a bank (not shown) of identical dilution control systems 100. For example, when the dilution control system 100 is used as a stand-alone unit, one of the fluid inlets 206 is coupled to the water source by, e.g., a hose (not shown) or other suitable connection, while the other fluid inlet 206 is preferably capped, e.g., using a threaded cap 217 (see FIGS. 1A and 1B). Further, when the dilution control system 100 is used in a bank of dilution control systems 100, one of the fluid inlets 206 may be coupled to the water source as described above, while the other fluid inlet 206 is coupled to a successive dilution control system 100. In this way, a plurality of dilution control systems 100 can be easily ganged together and operated from the same water source. The uncoupled fluid inlet 206 of the dilution control system 100 at the distal end of the bank of systems 100 is then preferably capped using the threaded cap 217.

It was also described above that the lower housing 120 encloses the fluid collector 280 and the water valve control mechanism 290, and that the control knob 130 of the water valve control mechanism 290 is used by the system operator for selecting a desired flow rate of diluted cleaning fluid from the dilution control system 100 by enabling the operation of the bottle valve levers 202 and 204. As shown in FIG. 2, the water valve control mechanism 290 further includes a knob retainer 294 coupled to both the control knob 130 and a control shaft 296, which in turn is coupled to a water valve actuator 298. The control shaft 296 and the water valve actuator 298 are enclosed within the lower housing 120, with the water valve actuator 298 pivotally mounted on an inner surface of the lower housing 120 and the control shaft 296 axially positioned for coupling with the knob retainer 294 outside the lower housing 120.

Accordingly, when the control knob 130 is rotated to the first position as described above (see FIG. 2), the knob retainer 294, the control shaft 296, and the water valve actuator 298 rotate as one, thereby causing an operative surface 297 of the water valve actuator 298 to impinge upon and actuate a water valve lever 205 (shown in its actuated position in FIG. 1D), thereby enabling the bottle valve lever 202 (also shown in its actuated position in FIG. 1D). Alternatively, when the control knob 130 is rotated to the second position as described above, the water valve control mechanism 290 causes another operative surface 299 of the water valve actuator 298 to impinge upon and actuate a water valve lever 207 (shown in its unactivated position in FIG. 1D), thereby enabling the bottle valve lever 204 (also shown in its unactivated position in FIG. 1D).

It should be noted that only one of the water valve levers 205 and 207 could be actuated at a time. Thus, when the control knob 130 is rotated, e.g., from the first position to the second position as described above, a return spring 408 (see FIG. 5) urges the water valve lever 205 to its unactivated position, thereby disabling the operation of the bottle valve lever 202. Further, the knob retainer 294 preferably includes a detent 295 for positioning and holding the control knob 130 in the second position, thereby maintaining the water valve lever 207 in its actuated position and conveniently allowing the system operator to fill, e.g., a bucket with diluted cleaning fluid without having to keep one hand on the control knob 130. The knob retainer 294 also preferably provides a positive "ON" to "OFF" actuation for automatically returning the control knob 130 back to the intermediate "OFF" position after the system operator rotates the control knob 130 to the first position, thereby temporarily maintaining the water valve lever 205 in its actuated position and allowing the system operator to fill, e.g., a spray bottle with diluted leaning fluid. This prevents the system operator from inadvertently overfilling the spray bottle.

As shown in FIG. 2, the collector 280 disposed in the lower housing 120 includes dilution chambers 282 and 284 with respective outlets 286 and 288. Accordingly, when the control knob 130 is in the first position as described above, thereby enabling the bottle valve lever 202, the chamber 282 simultaneously collects water from the outlet 212 of the water manifold assembly 200 and concentrated chemical cleaning fluid from the bottle 150 through the flow port 572 of the valve insert 170. The water and the concentrated chemical cleaning fluid are then allowed to mixed in the chamber 282; and, the diluted mixture is subsequently dispensed through the chamber outlet 286, which may optionally be connected to a hose (not shown) for conveniently filling, e.g., a spray bottle with the diluted cleaning fluid.

Similarly, when the control knob 130 is in the second position as described above, thereby enabling the bottle valve lever 204, the chamber 284 simultaneously collects water from the outlet 213 of the water manifold assembly 200 and concentrated chemical cleaning fluid from the bottle 150 through the flow port 574 of the valve insert 170. The water and the concentrated chemical cleaning fluid are then allowed to mixed in the chamber 284; and, the diluted mixture is subsequently output through the chamber outlet 288, which may optionally be connected to another hose (not shown) for conveniently filling, e.g., a bucket with the diluted cleaning fluid.

For this illustrative embodiment, whether or not the outlets 286 and 288 of the collector 280 are used for filling, e.g., a spray bottle or a bucket with diluted cleaning fluid is dependent upon the selected flow rate of the concentrated chemical fluid from the bottle 150. This is described in further detail below with respect to the operation of the dilution control system 100.

In accordance with standardized plumbing codes, there is preferably an air gap of at least about one (1) inch between the top edges (not numbered) of the collector chambers 282 and 284 and the outlets 212 and 213, respectively, of the water manifold assembly 200. This is for protecting the water source from contamination in a "back-flow" situation. For example, back-flow may cause reverse water pressure in a line providing water from the water source, thereby resulting in some fluid being drawn from the water manifold assembly 200 through the line toward the water source. By providing the air gap between the collector 280 and the fluid outlets 212 and 213, any diluted chemical fluid that might be in the collector 280 cannot also be drawn back through the water manifold assembly 200 toward the water source in the back-flow situation. This minimizes any potential water source contamination that might occur.

Figure 5:
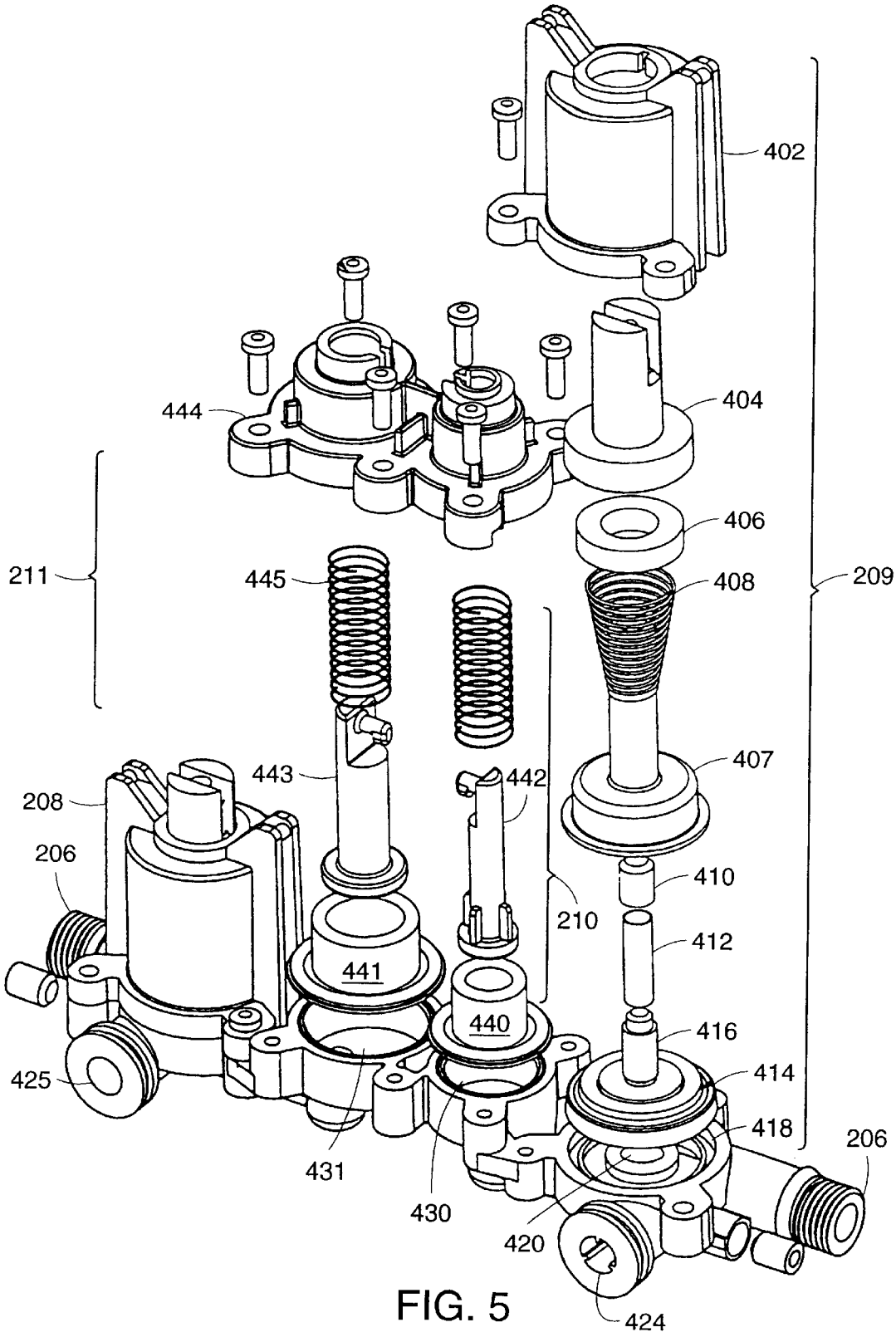
FIG. 5 is an exploded view of another portion of the water manifold assembly according to the present invention.

FIG. 5 shows an exploded view of another portion of the water manifold assembly 200. As mentioned above, the water manifold assembly 200 includes the pair of fluid inlets 206, the fluid valve assemblies 208 and 209, the fluid diaphragm assemblies 210 and 211, the bottle valve levers 202 and 204 (see FIG. 1D), and the outlets 212 and 213 (see FIG. 4) for outputting water from the water source to the collector chambers 282 and 284 (see FIG. 2), respectively.

The fluid valve assemblies 208 and 209 are of conventional design and may be obtained from several manufacturers such as HORTON™, VERNEY™, and DEMA™. Specifically, each of the fluid valve assemblies 208 and 209 typically includes a valve diaphragm 414 for controlling the flow of water from the inlets 206 through the water manifold assembly 200. More specifically, each fluid valve assembly 208 or 209 typically includes a steel diaphragm actuator 416, a coil spring 412, and a spacer 410, which are held in the relative positions shown in FIG. 4 by a guide 407 seated over the valve diaphragm 414. Further, each fluid valve assembly 208 or 209 typically includes a magnet 406 and an actuator button 404, which is pivotally coupled to the water valve lever 205 or 207 (see FIG. 1D).

When the water valve lever 205 or 207 is in its unactivated position, the spring 412 is normally biased to urge the diaphragm actuator 416 against the valve diaphragm 414, thereby preventing water from flowing from the channel 214 through the water valve assembly 208 or 209. Specifically, when the spring 412 is in its normally biased position, the diaphragm actuator 416 is urged against the valve diaphragm 414, which seats itself in a circular chamber 418 or 419 (see also FIGS. 4 and 6A) and forms a seal around the edge (not numbered) of a circular passage 420 or 421 (see also FIG. 6A). Accordingly, the valve diaphragm 414 is made of a resilient material such as rubber and is adapted to seal against the seat formed around the edge of the circular passage 420 or 421 (see also FIGS. 4 and 6A).

For example, FIG. 1D shows the water valve lever 207 in its unactivated position. Accordingly, water is prevented from flowing from the channel 214 through an opening 423 (see FIG. 6A) into the chamber 419 and then through the circular passage 421. This is because the normally biased spring 412 urges the diaphragm actuator 416 against the valve diaphragm 414, thereby causing the valve diaphragm 414 to push against and form a seal around the edge (not numbered) of the circular passage 421. Further, FIG. 6B is a cross-sectional view of the portion of the water manifold assembly 200 shown in FIG. 6A along the line A—A. Specifically, FIG. 6B shows a flow 600 of water from the inlet 206, through the channel 214, and to the opening 423 between the channel 214 and the chamber 419.

Figure 6A:
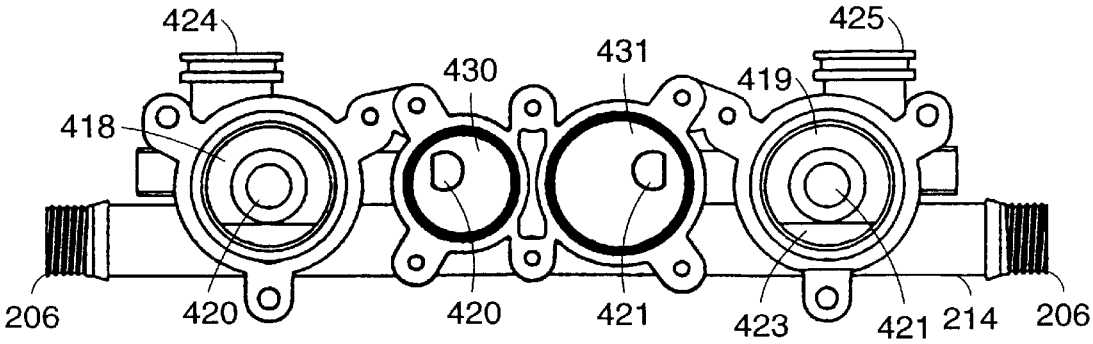
FIG. 6A is a top plan view of part of the water manifold assembly shown in FIG. 5.
Figure 6B:
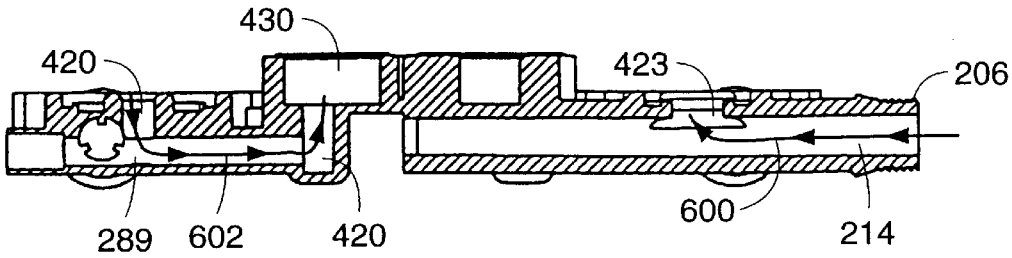
FIG. 6B is a cross-sectional view of the part of the water manifold assembly shown in FIG. 6A.

The circular chamber 418 is in fluid communication with both an adjacent circular chamber 430 (see FIGS. 4 and 6A) through the passage 420 (see FIG. 6A), and the fluid outlet 212 through the passage 424 (see FIGS. 4 and 6A). Similarly, the circular chamber 419 is in fluid communication with both an adjacent circular chamber 431 (see FIGS. 4 and 6A) through the passage 421 (see FIG. 6A), and the fluid outlet 213 through the passage 425 (see FIGS. 4 and 6A). Accordingly, when the water valve levers 205 and 207 are alternately in their unactivated positions, water is prevented from flowing from the chamber 418 to the chamber 430 and the outlet 212, and from the chamber 419 to the chamber 431 and the outlet 213.

It should be noted that the diameter of the chamber 431 is larger than that of the chamber 430. This is because the chamber 431 is in fluid communication with the outlet 213, which is used when filling, e.g., a bucket with the diluted cleaning fluid; and, the chamber 430 is in fluid communication with the outlet 212, which is used when filling, e.g., a spray bottle with the diluted cleaning fluid. The larger diameter chamber 431 therefore provides a greater water flow for filling the bucket; and, the smaller diameter chamber 430 provides a lesser water flow for filling the spray bottle.

When the water valve lever 205 or 207 is in its actuated position, the actuator button 404 pushes the magnet 406 toward the steel diaphragm actuator 416, thereby allowing magnetic attraction between the magnet 406 and the actuator 416 to overcome the normal bias of the spring 412. As a result, the actuator 416 is drawn toward the magnet 406 and away from the valve diaphragm 414. For example, this allows water entering the chamber 418 from the channel 214 to push the valve diaphragm 414 away from the passage 420, and therefore pass through the passage 420 to the adjacent chamber 430 and through the passage 424 to the outlet 212. Specifically, FIG. 6B shows a flow 602 of water from the passage 420, through a channel 289 parallel to the channel 214, and to the passage 420 between the channel 289 and the chamber 430. Alternatively, water entering the chamber 419 from the channel 214 pushes the valve diaphragm 414 away from the passage 421, and passe s through the passage 421 to the adjacent chamber 431 and through the passage 425 to the outlet 213. Finally, each of the fluid valve assemblies 208 and 209 typically includes a cover 402.

The fluid diaphragm assemblies 210 and 211 include respective circular bellows 440 and 441 , and respective pistons 442 and 443 with return coil springs 445 disposed thereon, and covers 444. The circular bellows 440 and 441 are seated on the edges (not numbered) of the circular chambers 430 and 431, respectively, and held in place by the covers 444, thereby sealing the chambers 430 and 431. Further, generally disk-shaped ends (not numbered) of the pistons 442 and 443 rest on the bellows 440 and 441, while elongated portions (not numbered) of the pistons 442 and 443 pass through holes (not numbered) in the covers 444; and, opposing ends (not numbered) of the pistons are slidingly coupled to the bottle valve levers 202 and 204, respectively.

For example, when water passes from the chamber 418 to the chamber 430 through the passage 420 (i.e., when the water valve lever 205 is in its actuated position), the water pushes against the bellows 440, thereby causing the bellows 440 to expand and in turn push against the disk-shaped end of the piston 442. A similar action occurs when water passes from the chamber 419 to the chamber 431 through the passage 421 (i.e., when the water valve lever 207 is in its actuated position), thereby causing the bellows 441 to expand and in turn push against the disk-shaped end of the piston 443.

In the preferred embodiment, the bellows 440 and 441 are caused to fully expand and push against the disk-shaped ends of the pistons 442 and 443, respectively, when the water pressure in the chambers 430 and 431 is equal to about 20 psi. Accordingly, the bellows 440 and 441 are also made of a resilient material such as rubber.

It was mentioned above that the diameter of the chamber 431 is larger than that of the chamber 430. As a result, in order to cooperate effectively with the chambers 431 and 430 and therefore generate enough force to push against the disk-shaped ends of the pistons 442 and 443, the diameter of the bellows 441 is larger than that of the bellows 440. Accordingly, the piston 443 is larger than the piston 442 for effectively cooperating with the larger bellows 441.

Because the ends of the pistons 442 and 443 opposite the disk-shaped ends are slidingly coupled near one end of the bottle valve levers 202 and 204, respectively, and the bottle valve levers 202 and 204 are pivotally coupled to the top platform 110 as shown in FIG. 1D, the fully expanded bellows 440 and 441 cause ends 216 and 218 (see FIG. 1D) of the bottle valve levers 202 and 204, respectively, to rotate toward the bottle 150 engaged with the dilution control system 100, for subsequent mating with the valve insert 170.

FIG. 4 also shows a flow regulator 450 between the passage 424 and the outlet 212. Similarly, another flow regulator 451 is disposed between the passage 425 and the outlet 213. In this illustrative embodiment, the flow port 572 can be used for providing a high flow rate of concentrated chemical fluid from the bottle 150; and, the flow port 574 can be used for providing a low flow rate of fluid from the bottle 150. Accordingly, the flow regulators 450 and 451 can be used for providing corresponding low and high flow rates of water for subsequently diluting the concentrated fluid that flows from the ports 574 and 572, respectively, into the collector chambers 282 and 284. In the preferred embodiment, the flow regulator 450 is used to provide a flow rate of about 1 gallon/minute of water through the outlet 212 to the collector chamber 282; and, the flow regulator 451 is used to provide a flow rate of about 4 gallons/minute of water through the outlet 213 to the collector chamber 284.

Figure 7A:
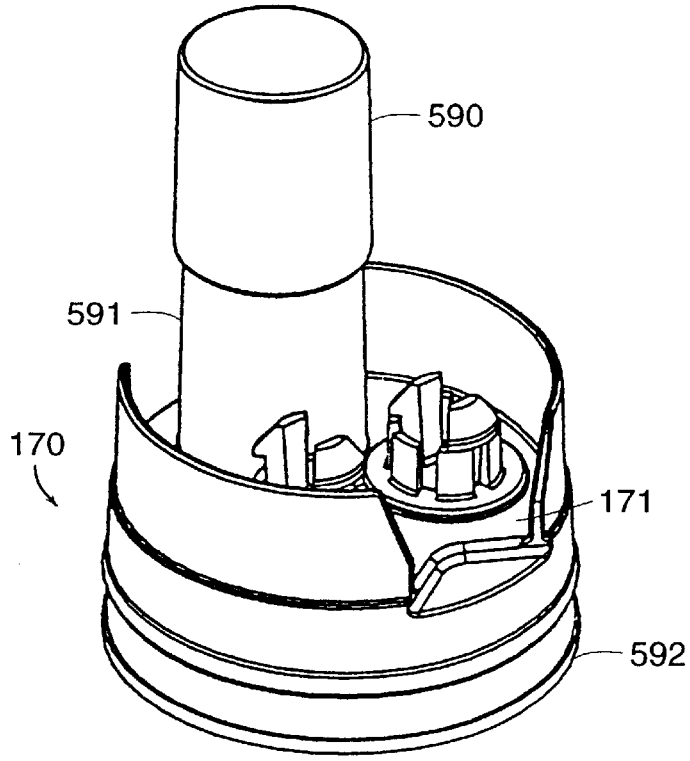
FIG. 7A is an isometric view of a valve insert in accordance with the present invention.
Figure 7B:
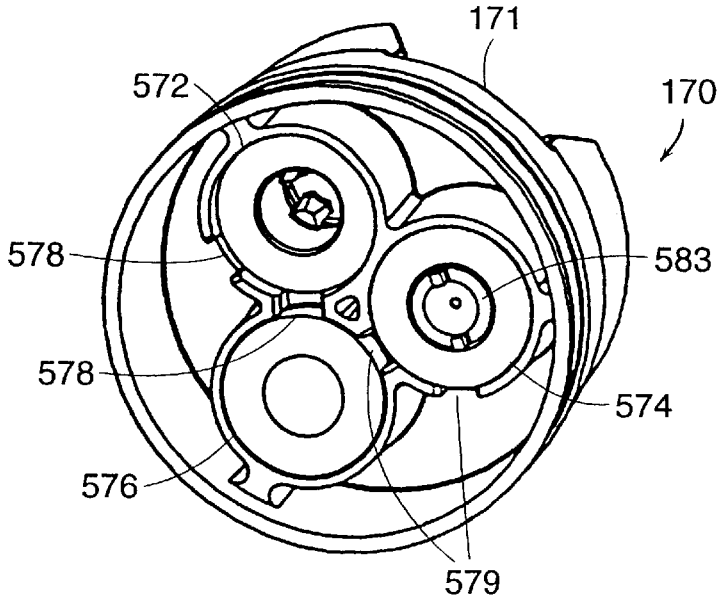
FIG. 7B is an isometric view of the valve insert showing a pair of chemical valves and an air vent according to the present invention.

FIGS. 7A and 7B show isometric views of the valve insert 170 in accordance with the present invention. As described above, the valve insert 170 includes the flow ports 572 and 574, and the air vent 576 (see FIG. 7B). The valve insert 170 further includes a keyway 171 for receiving a key 153 (see FIG. 9B) radially projecting inwardly from the neck of the bottle 150. Accordingly, the valve insert 170 is preferably press-fit into the opening of the bottle 150 with the keyway 171 receiving the key 153 on the bottle 150. This further ensures that the valve insert 170 is properly oriented with the dilution control system 100 when the bottle 150 is fully engaged with the system 100.

Figure 8:
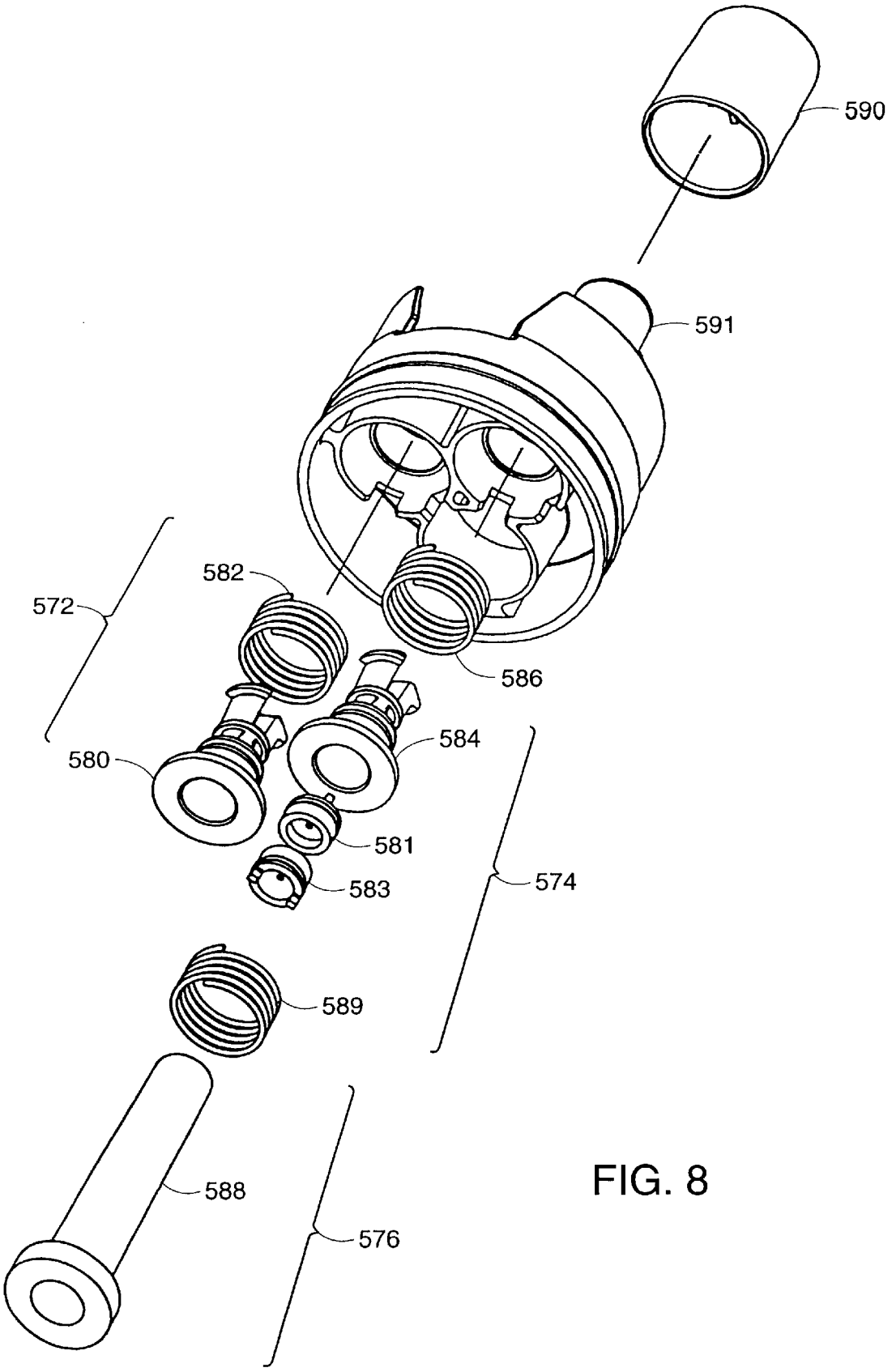
FIG. 8 is an exploded view of the valve insert shown in FIG. 7A.

FIG. 8 shows an exploded view of the valve insert 170. Specifically, the flow port 572 includes a chemical valve 580 and a return coil spring 582, and is seated and retained in a first opening (not numbered) in the valve insert 170. Similarly, the flow port 574 includes a chemical valve 584 and a return coil spring 586, and is seated and retained in a second opening (not numbered) in the valve insert 170. Further, metering tips 581 and 583 can optionally be press-fit into openings (not numbered) of the valves 580 and 584 for further restricting and regulating the flow of concentrated chemical cleaning fluid from the bottle 150. In addition, the air vent 576 includes an extender portion 588, a return coil spring 589, and a cap 590, and is seated and retained in a third opening (not numbered) in the valve insert 170.

As described above, the fully expanded bellows 440 and 441 cause the ends 216 and 218 of the bottle valve levers 202 and 204, respectively, to rotate toward the valve insert 170 for subsequent mating. Specifically, each end 216 or 218 includes a generally cylindrically-shaped portion 221 (see FIGS. 1C and 1D) with keys 220 (see FIGS. 1C and 1D) radially projecting therefrom. Further, the valve insert 170 includes keyways 578 and 579 (see FIG. 7B) for receiving the radially projecting keys 220 during mating of the ends 216 and 218 with the valve insert 170, thereby selectively actuating the flow ports 572 and 574, and the air vent 576.

For example, as the end 216 of the bottle valve lever 202 rotates toward the valve insert 170, the keys 220 are received in the keyways 578. Further, the cylindrical portion 221 depresses the valve 580 until the spring 582 is substantially fully compressed in the first opening of the valve insert 170; and, the key 220 received in the keyway 578 between the flow port 572 and the air vent 576 depresses the extender portion 588 until the spring 589 is substantially fully compressed in the third opening of the valve insert 170. As a result, the end 216 of the bottle valve lever 202 simultaneously mates with and actuates the flow port 572 and the air vent 576 of the valve insert 170.

Alternatively, as the end 218 of the bottle valve lever 204 rotates toward the valve insert 170, the keys 220 are received in the keyways 579. The cylindrical portion 221 then depresses the valve 584 until the spring 586 is substantially fully compressed in the second opening of the valve insert 170; and, the key 220 received in the keyway 579 between the flow port 574 and the air vent 576 depresses the extender portion 588 until the spring 589 is substantially fully compressed in the third opening of the valve insert 170. In this way, the end 218 of the bottle valve lever 204 simultaneously mates with and actuates the flow port 574 and the air vent 576 of the valve insert 170.

Specifically, the chemical valves 580 and 584 are of conventional design and include fingers (not numbered) that expand outwardly as the valves 580 and 584 are depressed by the bottle valve levers 202 and 204, respectively, thereby causing the valves 580 and 584 to open and allow concentrated chemical cleaning fluid to be dispensed from the bottle 150. As the ends 216 and 218 of the bottle valve levers 202 and 204, respectively, selectively rotate away from the valve insert 170, the return springs 582 and 586 urge the valves 580 and 584, respectively, to their original positions, thereby compressing the fingers and causing the valves 580 and 584 to close.

Further, the air vent 576 is used for venting the bottle 150 as the concentrated chemical cleaning fluid is dispensed therefrom through either the flow port 572 or 574. Specifically, when the air vent 576 is in its unactivated state, the cap 590 rests on an elongated tubular portion 591 (see FIG. 7A), thereby forming a seal around an edge (not numbered) of the tubular portion 591. As the extender portion 588 is depressed by the bottle valve levers 202 or 204, the extender portion 588 pushes against the cap 590, thereby breaking the seal. Because the bottle valve levers 202 and 204 simultaneously mate with and actuate either the flow port 572 and the air vent 576, or the flow port 574 and the air vent 576, this means that air can pass through the tubular portion 591, around the cap 590, and into the bottle 150, thereby displacing concentrated chemical fluid being dispensed from the bottle 150 through either the flow port 572 or 574.

More specifically, as the bottle valve levers 202 and 204 actuate the flow ports 572 or 574 and the air vent 576, the bottle 150 is vented via the air vent 576 while the fluid in the bottle 150 follows the path of least resistance through either the flow port 572 or 574. The cap 590 also preferably includes features (not shown) for preventing the cap 590 from being completely separated from the tubular portion 591. Further, as the ends 216 and 218 of the bottle valve levers 202 and 204, respectively, rotate away from the valve insert 170, the return spring 589 urges the extender portion 588 to its original position, thereby allowing the cap 590 to form the sealing surface against the tubular portion 591.

The operation of the dilution control system 100 will now be described in accordance with the following illustrative example. In this example, the dilution control system 100 is preferably mounted to a wall (not shown) such that the control knob 130 is opposite the surface of the lower housing 120 mounted against the wall. Alternatively, the dilution control system 100 may be similarly mounted to a movable cart (not shown). This gives the system operator easy access to the dilution control system 100 as a whole and to the control knob 130 in particular. Further, the dilution control system 100 is preferably mounted near a water source (not shown), e.g., a water faucet, so that water can be easily provided to the system 100 using a hose (not shown) or other suitable structure coupled to the faucet. In addition, in this illustrative example, the dilution control system 100 is operated as a stand-alone unit. Accordingly, one end of the tubular channel 214 coupling the fluid inlets 206 is capped using the threaded cap 217, while the other end of the tubular channel 214 is coupled to the water faucet via the hose. The outlets 286 and 288 may also be connected to respective hoses (not shown) for facilitating the filling of a spray bottle or a bucket with diluted cleaning fluid.

First, the system operator obtains a bottle of concentrated chemical cleaning fluid, such as the bottle 150. If the bottle 150 does not al ready have the valve insert 170 disposed therein, then the system operator obtains the valve insert 170 and inserts it into the opening of the bottle 150, taking care to align the keyway 171 on the valve insert 170 with the key 153 projecting inwardly from the neck of the bottle 150. In this way, the valve insert is press-fit into the opening of the bottle 150 so that an outer edge 592 (see FIG. 7A) of the valve insert 170 is substantially flush with the bottle opening.

The system operator then inverts the bottle 150 for engaging it with the dilution control system 100. Because the valve insert 170 is securely press-fit into the opening of the bottle 150, and the flow ports 572 and 574 and the air vent 576 are in their unactivated positions, no concentrated chemical cleaning fluid is allowed to escape from the inverted bottle 150. Next, the system operator engages the inverted bottle 150 with the dilution control system 100.

The system of keys 152 and 153 and keyways 112 and 171 make it easy for system operators to properly orient the valve insert 170 with both the bottle 150 and the top platform 110 of the dilution control system 100. As a result, after the system operator engages the inverted bottle 150 with the dilution control system 100, he or she can be confident that the valve insert 170 is also properly aligned with the bottle valve levers 202 and 204 coupled to the water manifold assembly 200 and that the dilution control system 100 is ready for use.

Next, the system operator turns on the water faucet, thereby causing water to flow into the channel 214 of the dilution control system 100. It is important to note that at this point in the operation of the dilution control system 100, there is no fluid flowing from the bottle 150. This is because the system operator has not yet rotated the control knob 130 for enabling the bottle valve lever 202 or 204. Significantly, water must be running through the dilution control system 100, and one of the bottle valve levers 202 or 204 must be enabled, in order for the fluid to be released from the bottle 150. This ensures that any concentrated chemical cleaning fluid that is released from the bottle 150 is subsequently and immediately diluted with the water running through the dilution control system 100. As a result, the probability that the system operator will come into contact with undiluted chemical cleaning fluid and/or otherwise misuse the system 100 is substantially reduced. This also ensures that the desired level of accuracy is achieved when diluting the concentrated chemical cleaning fluid.

As explained above, whether or not the outlets 286 and 288 of the dilution control system 100 are used for filling, e.g., a spray bottle or a bucket with diluted cleaning fluid is dependent upon the selected flow rate of the concentrated chemical cleaning fluid from the bottle 150. Accordingly, the system operator selects the flow rate of the fluid from the bottle 150 using the control knob 130.

In this illustrative example, when the system operator rotates the control knob 130 in a clockwise fashion from the intermediate "OFF" position to a first position, he or she selects a low flow rate of fluid from the bottle 150. Alternatively, when the system operator rotates the control knob 130 in a counter-clockwise fashion from the intermediate "OFF" position to a second position, he or she selects a high flow rate of fluid from the bottle 150. As explained above, the metering tips 581 and 583 can be press-fit into the openings of the appropriate chemical valves 580 and 584 for regulating the low and high flow rates of the fluid from the bottle 150 when the control knob 130 is rotated to either the first or the second position.

The system operator then rotates the control knob 130 to, e.g. the first position for subsequently obtaining a low flow rate of concentrated chemical cleaning fluid from the bottle 150. As a result, the water valve lever 205 is actuated by the water valve actuator 298 included in the water valve control mechanism 290. It should be understood that the system operator might alternatively rotate the control knob 130 to, e.g., the second position for obtaining a high flow rate of cleaning fluid from the bottle 150.

Because the water valve lever 205 is actuated, water enters the chamber 418, thereby pushing the valve diaphragm 414 away from the passage 420. The water then passes through the passage 420 to the adjacent chamber 430 and also through the passage 424 to the outlet 212.

When the water pressure in the chamber 430 is at least about 20 psi, the bellows 440 in, e.g., the fluid diaphragm assembly 210 fully expands and pushes against the disk-shaped end of the piston 442. Because the opposite end of the piston is coupled to, e.g., the bottle valve lever 202 pivotally coupled to the top platform 110, the end 216 of the bottle valve lever 202 rotates toward the valve insert 170 in the bottle 150.

In this illustrative example, the keys 220 projecting from the cylindrically-shaped portion 221 of the end 216 are then received in the keyways 578, thereby allowing the cylindrical portion 221 and the keys 220 to actuate the flow port 572 and the air vent 576 in the valve insert 170. Specifically, the chemical valve 580 and the extender portion 588 of the air vent 576 are depressed, thereby allowing fluid to flow out of the bottle 150 through the valve 580 and air to flow into the bottle 150 through the air vent 576.

Next, both the water flowing through the outlet 212 and the concentrated chemical cleaning fluid flowing through the flow port 572 enter the collector chamber 282, where the water and the concentrated chemical cleaning fluid are allowed to mix. In this illustrative example, the flow regulator 450 is used for providing a low flow rate of water through the outlet 212 and into the collector chamber 282, thereby corresponding with the low flow rate of cleaning fluid through the flow port 574. Finally, the chemical cleaning fluid mixed and diluted with water is dispensed through the outlet 286 of the collector chamber 282 and the hose connected thereto, and into the spray bottle for subsequent use. The system operator then rotates the control knob 130 back to the intermediate "OFF" position, and turns-off the water faucet.

Because water must be running through the dilution control system 100 in order for fluid to be released from the bottle 150, no fluid is allowed to escape from the bottle 150 after the system operator turns-off the water faucet. As a result, any chance that concentrated chemical cleaning fluid might inadvertently leak from the inverted bottle 150 when the dilution control system 100 is not in use is virtually eliminated.

After all of the concentrated chemical cleaning fluid in the bottle 150 has been diluted with water using the dilution control system 100, the system operator normally discards the bottle 150 with the valve insert 170 disposed therein in an environmentally safe manner.

It follows from the above description that important advantages are derived from the dilution control system of the present invention. For example, the dilution control system dilutes and dispenses concentrated chemical cleaning fluids accurately. This is because the metering tips and the flow regulators can be used for accurately regulating both the flow of cleaning fluid from a bottle engaged with the system and the flow of water from a water source through the system.

In addition, the dilution control system dilutes and dispenses concentrated chemical cleaning fluid with a higher degree of safety as compared with conventional systems. This is because cleaning fluid is released from the bottle only when water is running through the dilution control system. As a result, the system operator normally cannot come into potentially harmful contact with undiluted chemical cleaning fluid and/or otherwise misuse the dilution control system.

In addition, the dilution control system is convenient to use. This is because the system of keys and keyways on both the dilution control system and the bottle engaged with the system, and the control knob for easily selecting fluid flow rates, make system set-up virtually foolproof. Further, because the cleaning fluid is released from the bottle only when water is running through a properly operating dilution control system, the system operator can be assured that no cleaning fluid will inadvertently escape from the bottle after he or she turns-off the water source for the system.

Having described one embodiment, numerous alternative embodiments or variations might be made. For example, it was described that the dilution control system is used for diluting and dispensing concentrated chemical cleaning fluid. However, this was merely an illustration. The dilution control system may be used for diluting and dispensing any fluid with another fluid so long as the fluids are compatible with the materials used to fabricate the dilution control system.

It was also described that the valve insert for use with the bottle of concentrated fluid has two (2) flow ports and one (1) air vent. However, this was also merely an illustration. Although the valve insert preferably has at least one air vent, the valve insert may alternatively have only one (1) flow port or more than two (2) flow ports for regulating the flow rate of fluid from the bottle. It follows that the water manifold assembly may alternatively be configured for actuating only one (1) flow port for dispensing fluid at a single flow rate, or it may be configured for actuating more than two (2) flow ports for selectively dispensing fluid from the bottle at a plurality of flow rates. The water manifold assembly may also be configured with a suitable number of fluid outlets for use with the different numbers of flow ports. Similarly, the collector may be configured with a suitable number of chambers for use in mixing and diluting fluids provided by the flow ports of the valve insert and the fluid outlets of the water manifold assembly.

Specific structures were also described for the water valve assemblies and the diaphragm assemblies included in the water manifold assembly. However, these were merely illustrations. Alternative structures may be used for starting, stopping, and/or regulating the flow of fluid through the water manifold assembly so long as these structures can be used to actuate the flow of concentrated fluid from the bottle only when there is water or other fluid flowing through the water manifold assembly. In this way, inadvertent release or leakage of the concentrated fluid from the bottle can be advantageously avoided.

A specific system of keys and keyways were also described for facilitating the insertion of the valve insert into the bottle and the engagement of the bottle with the top platform of the dilution control system. However, this was also merely an illustration. Alternate systems and configurations may be used for facilitating the set-up of the dilution control system. For some applications it might even be preferable not to have keys and keyways for guiding the engagement of the bottle with the system. This would make it possible to use a greater variety of types of bottles with the dilution control system. Similarly, a specific system of keys and keyways was described for mating and engaging the bottle valve levers of the water manifold assembly with the flow ports and the air vent of the valve insert. However, alternate systems and configurations may be used for ensuring proper actuation of the fluid and air valves.

It will also be apparent to those skilled in this art that other changes can be made in the embodiment described herein without departing from the spirit and scope of the present invention. Therefore, the present invention should be limited only by the spirit and scope of the appended claims.

What is claimed is:

1. A system for diluting and dispensing a fluid, comprising:

a bottle adapted for receiving a quantity of the fluid, the bottle having at least one first valve disposed in an opening thereof for controlling the flow of the fluid from the bottle, the first valve being biased to a closed position; and dilution and dispenser assembly for supporting the bottle while diluting and dispensing the fluid, the assembly including a body having at least one chamber with a receiving opening and a dispensing opening, a platform for engaging and supporting the bottle on the body with the opening of the bottle being directed downward in registration with the receiving opening of the chamber, and a manifold assembly including at least one inlet for receiving a second fluid, at least one outlet in fluid communication with the inlet, the outlet being directed downward in registration with the receiving opening of the chamber, at least one actuator in fluid communication with the inlet for moving the first valve disposed in the opening of the bottle to an open position, the actuator being triggered by the second fluid flowing through the manifold assembly, and at least one second valve for controlling the flow of the second fluid from the inlet to both the outlet and the actuator, the second valve being biased to a closed position and shiftable to an open position, whereby when the second valve is shifted to the open position, the second fluid flows from the inlet to the outlet and into the chamber and triggers the actuator, thereby causing the fluid in the bottle to flow into the chamber and be mixed with the second fluid for subsequent dispensing of diluted fluid through the dispensing opening of the chamber.

2. The system as recited in claim 1, wherein the bottle further includes an air valve disposed in the opening thereof for controlling the flow of air into the bottle and displacing the fluid flowing out of the bottle and into the chamber, the air valve being biased to a closed position, and wherein the actuator simultaneously moves the first valve and the air valve to respective open positions when triggered by the second fluid flowing through the manifold assembly.

3. The system as recited in claim 1, wherein the bottle has at least one key on a neck thereof and the platform has an opening with a keyway for receiving the key on the bottle.

4. The system as recited in claim 1, wherein the dilution and dispensing assembly further includes a switch operatively coupled to the body for selectively shifting the second valve to the open and the closed positions.

5. The system as recited in claim 1, wherein the inlet of the manifold assembly is in fluid communication with a water source.

6. The system as recited in claim 1, wherein the first valve includes at least one metering tip for regulating the flow rate of the fluid from the bottle, through the first valve, and into the chamber.

7. The system as recited in claim 1, wherein at least one flow regulator is disposed between the inlet and the outlet of the manifold assembly for regulating the flow rate of the second fluid into the chamber.

8. The system as recited in claim 1, wherein the actuator includes a diaphragm and the second fluid triggers the actuator by applying force to and expanding the diaphragm.

9. The system as recited in claim 8, wherein the actuator is triggered when the force applied to the diaphragm is at least 20 psi.

10. The system as recited in claim 8, wherein the actuator includes a valve arm and the expanding diaphragm pushes against the valve arm for moving the first valve disposed in the opening of the bottle to the open position.

11. A dilution and dispenser assembly for use with a system for diluting and dispensing a fluid, the system including a bottle adapted for receiving a quantity of the fluid, the bottle having at least one first valve disposed in an opening thereof for controlling the flow of the fluid from the bottle, the first valve being biased to a closed position, wherein the dilution and dispenser assembly supports the bottle while diluting and dispensing the fluid, the dilution and dispenser assembly comprising:

a body having at least one chamber with a receiving opening and a dispensing opening;

a platform for engaging and supporting the bottle on the body with the opening of the bottle being directed downward in registration with the receiving opening of the chamber; and a manifold assembly including at least one inlet for receiving a second fluid, at least one outlet in fluid communication with the inlet, the outlet being directed downward in registration with the receiving opening of the chamber, at least one actuator for moving the first valve disposed in the opening of the bottle to an open position, the actuator being triggered by the second fluid flowing through the manifold assembly, and at least one second valve for controlling the flow of the second fluid from the inlet to both the outlet and the actuator, the second valve being biased to a closed position and shiftable to an open position, whereby when the second valve is shifted to the open position, the second fluid flows from the inlet to the outlet and into the chamber and triggers the actuator, thereby causing the fluid in the bottle to flow into the chamber and be mixed with the second fluid for subsequent dispensing of diluted fluid through the dispensing opening of the chamber.

12. The assembly as recited in claim 11, further including a switch operatively coupled to the body for allowing a human operator to selectively shift the second valve to the open and the closed positions.

13. The assembly as recited in claim 1, wherein the inlet of the manifold assembly is in fluid communication with a water source.

14. The assembly as recited in claim 11, wherein the bottle further includes an air valve disposed in the opening thereof, the air valve being biased to a closed position, and wherein the actuator simultaneously moves the first valve and the air valve to respective open positions when triggered by the second fluid flowing through the manifold assembly.

15. The assembly as recited in claim 11, further including at least one flow regulator disposed between the inlet and the outlet of the manifold assembly for regulating the flow rate of the second fluid into the chamber.

16. The assembly as recited in claim 11, wherein the actuator includes a diaphragm, a piston, and a valve arm pivotally coupled to the platform, a proximal end of the valve arm being slidingly coupled to the piston and a distal end of the valve arm being adapted for moving the first valve, and wherein the second fluid triggers the actuator by applying force to and expanding the diaphragm, thereby causing the diaphragm to push against the piston and operate the valve arm for moving the first valve to the open position.

17. The assembly as recited in claim 16, wherein the actuator is triggered when the force applied to the diaphragm is at least 20 psi.

18. The assembly as recited in claim 11, wherein the bottle has at least one key radially projecting from a neck thereof and the platform has an opening with a keyway for receiving the key on the bottle.

19. The assembly as recited in claim 18, wherein a latch assembly is operatively coupled to the platform for mating and engaging with at least one ridge projecting from the neck of the bottle when the bottle is engaged with the opening of the platform.

20. The assembly as recited in claim 16, wherein the distal end of the valve arm has at least one key radially projecting therefrom, and wherein the bottle further includes an air valve disposed in the opening thereof with a keyway disposed between the air valve and the first valve for receiving the key on the distal end of the valve arm, whereby the keyway between the air valve and the first valve guides the key on the distal end of the valve arm for simultaneously moving the air valve and the first valve to respective open positions.

21. A gravity-feed dilution and dispenser assembly for use with a system for diluting and dispensing a fluid, the system including a container for dispensing a cleaning solution, the container activated to dispense solution by a mechanism of the assembly, without rotation of the container.

22. A gravity-feed dilution and dispenser assembly of claim 21, wherein the mechanism activates the container to dispense solution when a diluting liquid is flowing through the assembly.

23. A gravity-feed dilution and dispenser assembly of claim 21, wherein the mechanism causes the container not to dispense solution when the diluting liquid is not flowing through the assembly.

24. A gravity-feed dilution and dispenser assembly of claim 22, wherein the mechanism activates the container to dispense solution when the diluting liquid is flowing through the assembly with a pressure of at least 20 psi.

25. A gravity-feed dilution and dispenser assembly of claim 22, wherein the cleaning solution being dispensed and the diluting liquid are mixed in a chamber and a diluted cleaning solution is dispensed therefrom.

26. A gravity-feed dilution and dispenser assembly of claim 22, wherein the mechanism includes a switch to selectively control dispensing solution from the container.

27. A gravity-feed dilution and dispenser assembly of claim 26, wherein the switch has an on and an off position and wherein the container dispenses solution when the switch is in the on position.

28. A gravity-feed dilution and dispenser assembly of claim 21, wherein the assembly further includes a vent mechanism so that the pressure in the container can equilibrate with atmospheric pressure as the cleaning solution is dispensed therefrom.

29. A gravity-feed dilution and dispenser assembly of claim 28, wherein the vent mechanism is selectively activated so as to allow the pressure in the container to equilibrate with atmospheric pressure when the solution is dispensed from the container and so as to seal the container when the solution is not being dispensed therefrom.

30. A gravity-feed dilution and dispenser assembly of claim 21, wherein the container has at least one first valve disposed in an opening thereof for controlling the flow of the solution from the container, the first valve being biased to a closed position, wherein the mechanism comprises:

a body having at least one chamber with a receiving opening and a dispensing opening;

a manifold assembly including:

at least one inlet for receiving a diluting liquid, at least one outlet in fluid communication with the inlet, the outlet being directed downward in registration with the receiving opening of the chamber, and at least one actuator for moving the first valve disposed in the opening of the container to an open position, the actuator being triggered by the diluting liquid flowing through the manifold assembly.

* * * * *